US010280946B2

(12) United States Patent
Tully et al.

(10) Patent No.: US 10,280,946 B2
(45) Date of Patent: May 7, 2019

(54) ADAPTER FOR MOUNTING A CYLINDER FOR A FLUID POWERED LINEAR ACTUATOR TO A FLUID CHANNEL

(71) Applicants: GREENLEE TEXTRON INC., Rockford, IL (US); GUSTAV KLAUKE GMBH, Remscheid (DE)

(72) Inventors: Gerald Jonathan Tully, Hampshire, IL (US); Egbert Georg Gottfried Frenken, Heinsberg (DE)

(73) Assignees: GREENLEE TOOLS, INC., Rockford, IL (US); GUSTAV KLAUKE GMBH, Remscheid (DE)

( * ) Notice: Subject to any disclaimer, the term of this patent is extended or adjusted under 35 U.S.C. 154(b) by 356 days.

(21) Appl. No.: 15/160,319

(22) Filed: May 20, 2016

(65) Prior Publication Data

US 2017/0336002 A1 Nov. 23, 2017

(51) Int. Cl.
*F15B 1/22* (2006.01)
*F15B 15/14* (2006.01)

(52) U.S. Cl.
CPC ..... *F15B 1/22* (2013.01); *F15B 15/149* (2013.01); *F15B 15/1423* (2013.01); *F15B 2201/41* (2013.01); *F15B 2201/415* (2013.01)

(58) Field of Classification Search
CPC ..... F15B 1/22; F15B 15/149; F15B 15/1423; F15B 2201/41; F15B 2201/415; F16L 27/087
USPC ..... 285/272, 273
See application file for complete search history.

(56) References Cited

U.S. PATENT DOCUMENTS 5,014,732 A * 5/1991 Nitzberg ..... 285/272 X
6,044,752 A 4/2000 Harigaya
6,086,112 A * 7/2000 Schofield ..... F16L 27/087
(Continued)

FOREIGN PATENT DOCUMENTS

DE 1186747 B 2/1965
DE 20 2011 052 083 U 4/2012
(Continued)

OTHER PUBLICATIONS

Zugvorsatz LS100LFLEXGL, Gustav Klauke GmbH, 2015, 2 pages.
(Continued)

*Primary Examiner* — Greg Binda
*Assistant Examiner* — Zachary T Dragicevich
(74) *Attorney, Agent, or Firm* — Klintworth & Rozenblat IP LLP

(57) ABSTRACT

An adapter is used to mount the cylinder to a fluid channel. The adapter is formed of a unitary wall including a first portion adapted to mount to the fluid channel, a second portion adapted to be engaged with a tool extending from the first portion, and a third portion extending from the second portion and seated within an inlet passageway of the cylinder. The third portion includes locking features for locking the adapter to the cylinder, and a sealing feature for sealing the adapter to the cylinder. The sealing feature is distal to the second portion such that when a torque is applied to the adapter, the sealing feature does not cause the adapter to shear. The cylinder and fluid channel may be capable of being swiveled relative to each other around the adapter, such swiveling may be up to 360 degrees and may be 360 degrees.

16 Claims, 13 Drawing Sheets

(56) References Cited

U.S. PATENT DOCUMENTS

2012/0247318 A1* 10/2012 Jubert ..... F15B 15/149
2015/0345521 A1* 12/2015 Yokota ..... F15B 15/1423

FOREIGN PATENT DOCUMENTS

| | | |
|---|---|---|
| FR | 2796673 | 1/2001 |
| GB | 2153436 | 8/1985 |

OTHER PUBLICATIONS

Zugvorsatz LS50LFLEX, Gustav Klauke GmbH, 2011, 2 pages.
Extended European Search Report for corresponding European Patent Application No. 17171850.5 dated Oct. 27, 2017, 8 pages.
Translation for DE 202011052083U1.
Translation for FR 2796673A1.
Translation for DE 1186747B.

* cited by examiner

ADAPTER FOR MOUNTING A CYLINDER FOR A FLUID POWERED LINEAR ACTUATOR TO A FLUID CHANNEL

FIELD OF THE DISCLOSURE

The present disclosure relates to an adapter capable of mounting a cylinder for a fluid powered linear actuator to a fluid channel.

BACKGROUND

An adapter is used to mount a cylinder used for a linear actuator on a relative to a fluid channel, which may allow the cylinder and fluid channel to rotate up to 360-degrees relative to each other. Cylinder inlets can often be difficult to design because of requirements that minimize size and weight leading to material reduction. The highest stress is often concentrated on cylinder designs at the inlet. This is especially the case with single acting cylinders with the inlet located on the rod side of the cylinder, or a pull cylinder, which is often preferred for hole making applications. High pressure cylinders where sealing methods must be more robust, also cause complications because maintaining the seal combined with joint integrity is even more challenging. Because of this high stress area created at the cylinder inlet, and thus deformation causing expansion and contraction, it can be difficult to find a permanent attachment for the cylinder housing that will be strong and not loosen over time, while maintaining a good inlet seal. Threaded applications tend to loosen and work themselves loose, and any internal locking mechanisms that are used internal to the cylinder design in the pressurized area, like pressed pins or snap rings, either increase stress problems or make assembly overly complicated and cost prohibitive.

SUMMARY

An adapter and an assembly including a cylinder and the adapter are provided. The adapter is used to mount the cylinder to a fluid channel. The adapter is formed of a unitary wall including a first portion adapted to mount to the fluid channel, a second portion adapted to be engaged with a tool extending from the first portion, and a third portion extending from the second portion and seated within an inlet passageway of the cylinder. The third portion includes locking features for locking the adapter to the cylinder, and a sealing feature for sealing the adapter to the cylinder. The sealing feature is distal to the second portion such that when a torque is applied to the adapter, the sealing feature does not cause the adapter to shear. The cylinder and fluid channel may be capable of being swiveled relative to each other around the adapter, such swiveling may be between 0 degree and 360 degrees, may be 360 degrees, and may be more than 360 degrees. Alternatively, in some embodiments, the fluid channel may be fixed in position relative to the adapter.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements in which.

DETAILED DESCRIPTION

Figure 1:
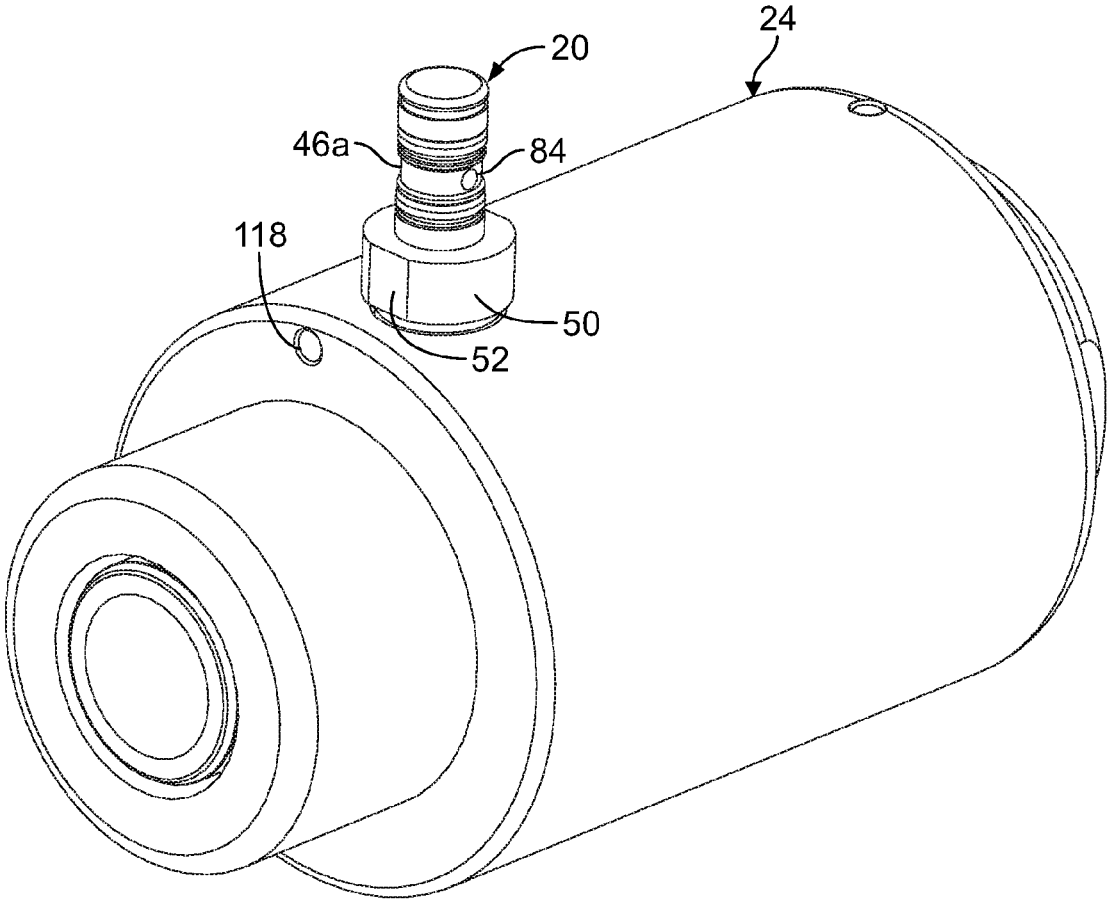
FIG. 1 is a perspective view of an adapter and a cylinder which incorporates features of the present disclosure.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

An adapter 20 is provided and is used to mount a fluid channel 22 to a cylinder 24 used for a linear actuator (not shown). The cylinder 24 and fluid channel 22 of some embodiments may be capable of being swiveled relative to each other around the adapter 20. The extent of swiveling permitted in such embodiments may vary depending on embodiment, with any with any upper maximum degree of rotation being between 0 and 360 degrees, and may be up to 360 degrees, and in some embodiments, more than 360 degrees of swiveling may be permitted. Alternatively, in some embodiments, the fluid channel 22 may be fixed in position relative to the adapter 20. fluid channel 22 receives a fluid medium under pressure from a source 26. The adapter 20 is designed such that its size and weight are minimized. The fluid medium can be hydraulic fluid, pneumatic fluid or other fluids.

The adapter 20 is formed of a unitary wall 28 and may be formed of metal. The wall 28 includes a first or proximal end 30, a fluid channel mounting portion 32 extending from the first end 30, a tool engaging portion 34 extending from the fluid channel mounting portion 32, a cylinder engaging portion 36 extending from the tool engaging portion 34 to a second or distal end 38 of the wall 28. A centerline 29 of the wall 28 is defined between the ends 30, 38. The fluid channel mounting portion 32 engages with the fluid channel 22 as described herein. The cylinder engaging portion 36 engages with the cylinder 24 as described herein.

As shown, the fluid channel mounting portion 32 includes a wall portion 40 which is cylindrical and defines a first diameter. As shown, a snap-ring recess 42 is provided in the wall portion 40 proximate to, but spaced from, the first end 30 of the wall 28. The snap-ring recess 42 may extend around the entire perimeter of the wall portion 40 or may extend around a portion of the perimeter of the wall portion 40. A first recess 44 is provided in the wall portion 40 proximate to, but spaced from, the snap-ring recess 42 and forms a first reduced diameter wall section 44*a* of the wall portion 40. The first recess 44 extends around the entire perimeter of the wall portion 40. The first reduced diameter wall section 44*a* defines a diameter which is less than the diameter of the wall portion 40. A second recess 46 is provided in the wall portion 40 proximate to, but spaced from, the first recess 44 and forms a second reduced diameter wall section 46*a* of the wall portion 40. The second recess 46 extends around the entire perimeter of the wall portion 40. The second reduced diameter wall section 46*a* defines a diameter which is less than the diameter of the wall portion 40, and greater than the first reduced diameter wall section 44*a*, however, the diameter of the second reduced diameter wall section 46*a* may be the same as the diameter of the first reduced diameter wall section 44*a*. A third recess 48 is provided in the wall portion 40 proximate to, but spaced from, the second recess 46 and forms a third reduced diameter wall section 48*a* of the wall portion 40. The third recess 48 extends around the entire perimeter of the wall portion 40. The third reduced diameter wall section 48*a* defines a diameter which is less than the diameter of the wall portion 40, and may be the same as the diameter of the first reduced diameter wall section 44*a*. While a particular fluid channel mounting portion 32 is shown and described, it is to be understood that other structures for mounting the fluid channel 22 are within the scope of the present disclosure.

The tool engaging portion 34 is formed of a wall having arcuate wall portions 50 interposed with flat wall portions 52. The flat wall portions 52 are opposed. The arcuate wall portions 50 define a diameter which is greater than the diameter of the wall portion 40 of the fluid channel mounting portion 32. A tool (not shown) can engage the flat wall portions 52 to rotate the adapter 20 relative to the cylinder 24. Other tool engaging structures can be provided.

The cylinder engaging portion 36 includes a first wall 54 which is cylindrical and defines a first diameter which extends from the tool engaging portion 34, a second wall 56 which is conical and extends from the first wall 54, a third wall 70 which is cylindrical and extends from the second wall 56 has a diameter which is less than the first wall 54, a fourth wall 72 which is conical and extends from the third wall 70, and a fifth wall 74 which is cylindrical and extends from the fourth wall 72 and has a diameter which is less than the third wall 70. The fourth wall 72 ends at the second end 38 of the wall 28. A recess 76 is provided in the fifth wall 74 proximate to, but spaced from, the second end 38 and forms a reduced diameter wall section 76*a* of the fifth wall 74. The recess 76 extends around the entire perimeter of the fifth wall 74. The reduced diameter wall section 76*a* defines a diameter which is less than the diameter of the fifth wall 74. The conical fourth wall 72 is angled relative to the third and fifth walls 70, 74 at a 60-degree angle. The angle at which the conical fourth wall 72 is angled relative to the third and fifth walls 70, 74 is greater than the angle at which the conical second wall 56 is angled relative to the third and fifth walls 70, 74. The second conical wall 56 may be eliminated such that the third wall 70 extends directly from the first wall 54.

The first wall 54 includes locking features as described herein to lock the adapter 20 to the cylinder 24. The fourth wall 72 forms a seat as described herein with the cylinder 24. The fifth wall 74 has a sealing feature as described herein to seal the adapter 20 to the cylinder 24. The sealing feature is spaced distally from the locking feature and from the tool engaging portion 34, such that when a torque is applied to the tool engaging portion 34, the sealing feature does not cause the adapter 20 to shear.

Figure 3:
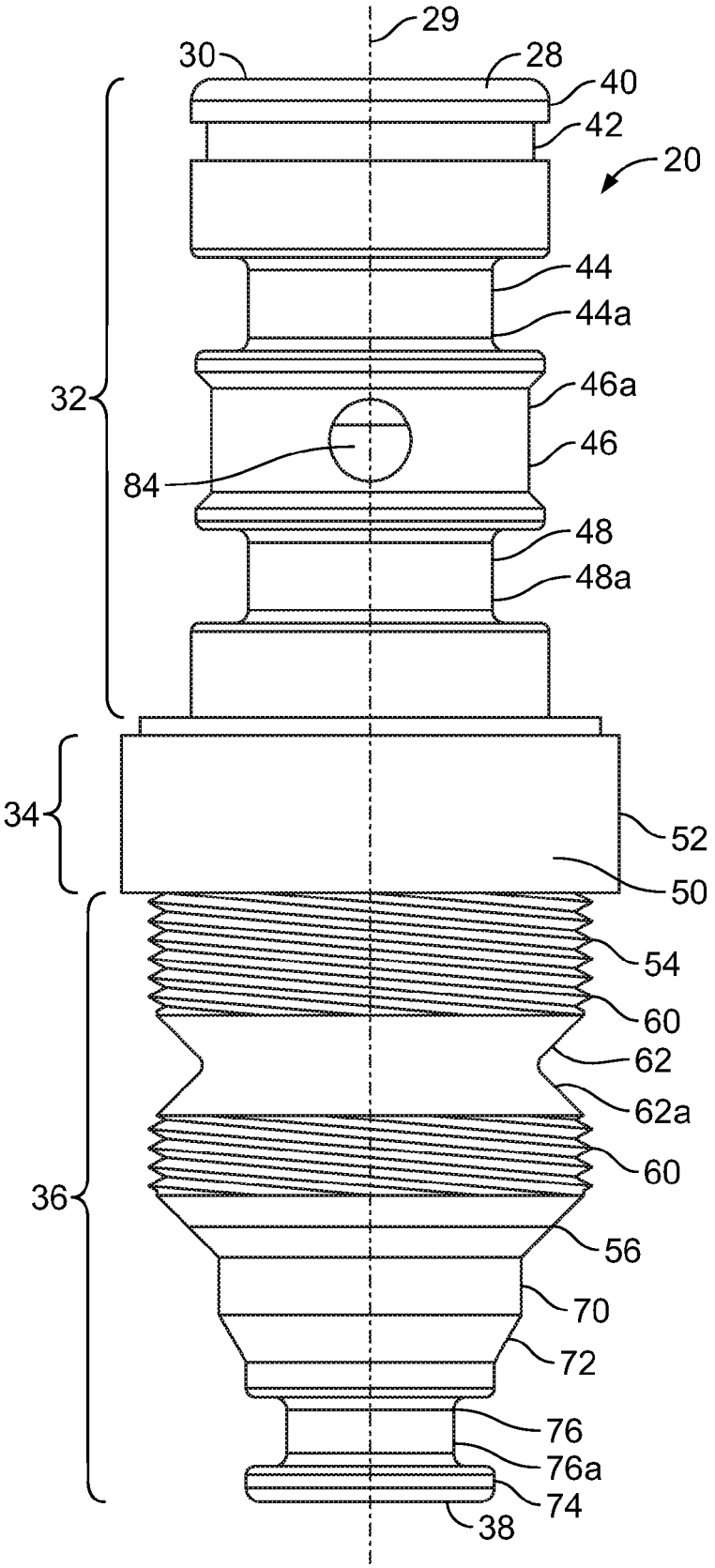
FIG. 3 is a side elevation view of the adapter.
Figure 4:
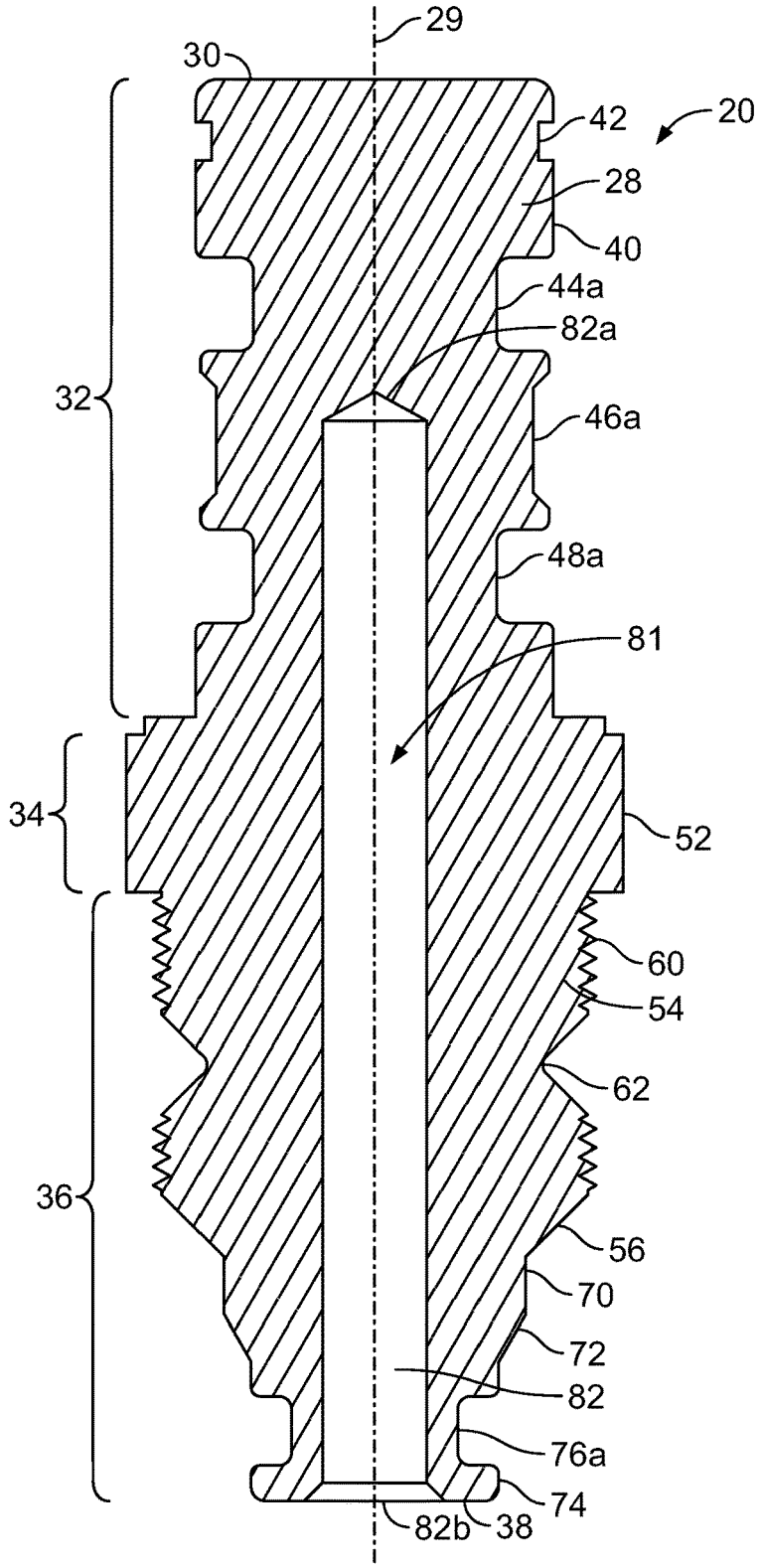
FIG. 4 is a cross-sectional view of the adapter.
Figure 6:
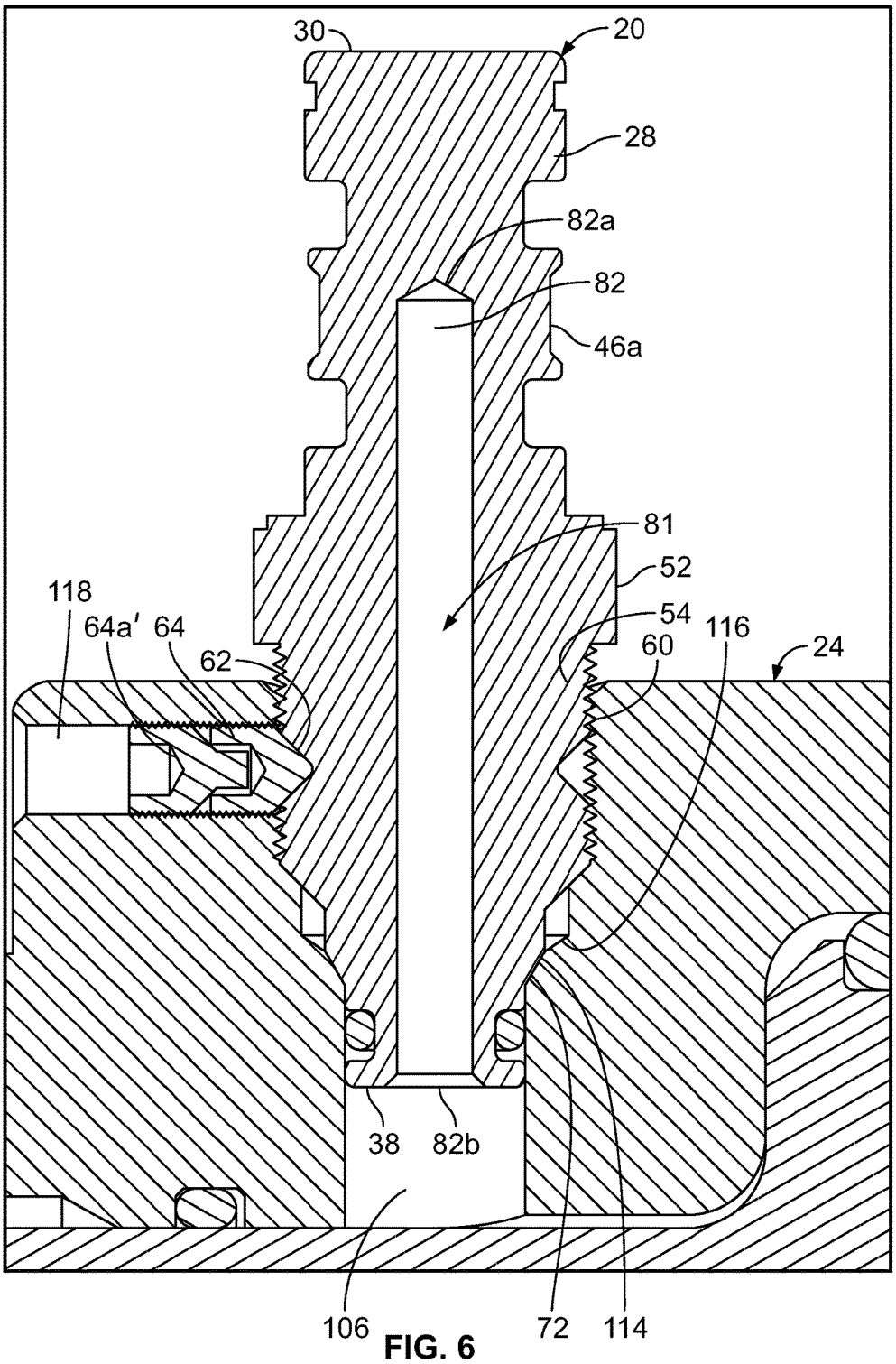
FIG. 6 is a cross-sectional view of the adapter and the inlet passageway of the cylinder.

In an embodiment as shown in FIGS. 3 and 4, the first wall 54 is threaded with threads 60 and has a groove 62 provided therein which is spaced from the tool engaging portion 34 and which forms a reduced diameter wall section 62*a* of the first wall 54. The groove 62 may extend around the entire perimeter of the first wall 54 or may extend around a portion of the perimeter of the first wall 54. The reduced diameter wall section 62*a* defines a diameter which is less than the minor diameter of the threads 60. As shown in FIG. 6, the fastener 64 seats within the groove 62 as described herein and forms a locking feature. The groove 62 may be formed by machining. In this embodiment, the load caused by pressure pushing the adapter 20 relative to the cylinder 24 is transferred to adapter 20, which transfers the load directly back to cylinder 24.

Figure 7:
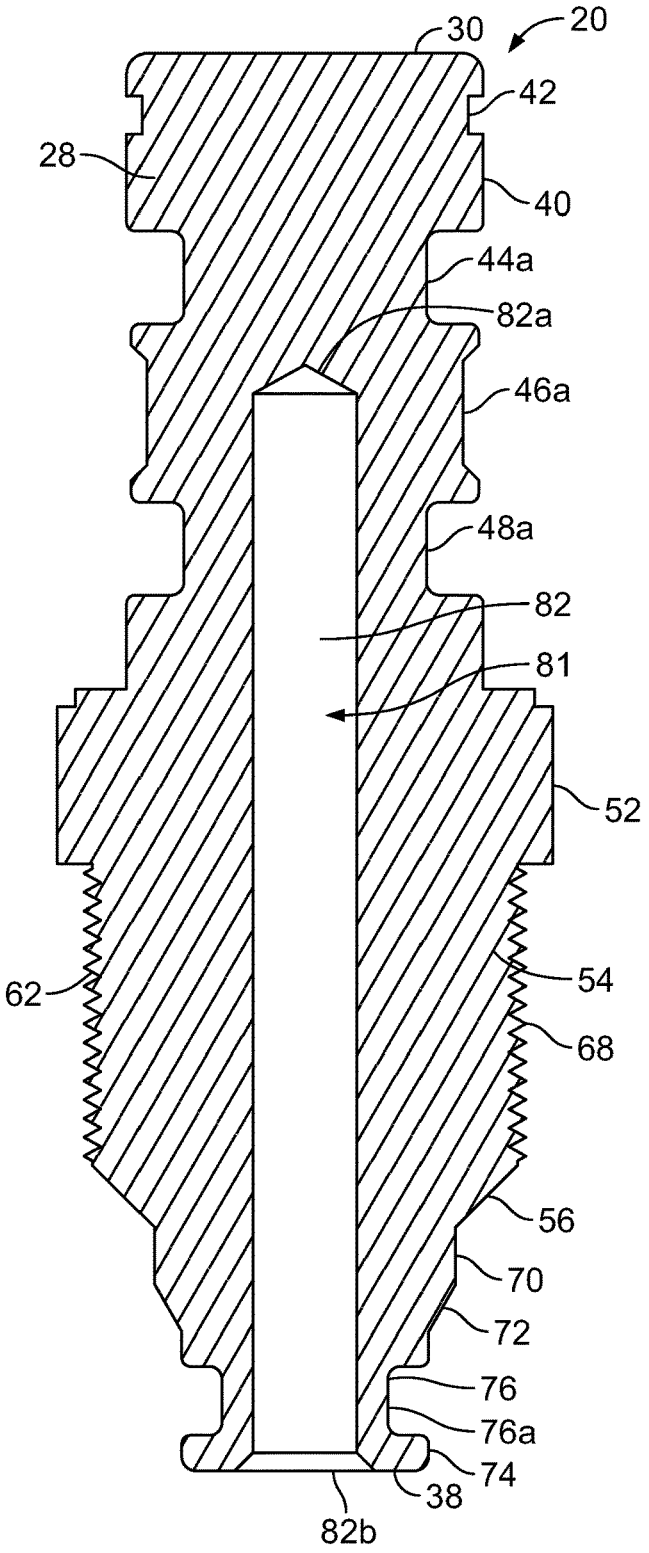
FIG. 7 is a cross-sectional view of an alternate adapter.
Figure 8:
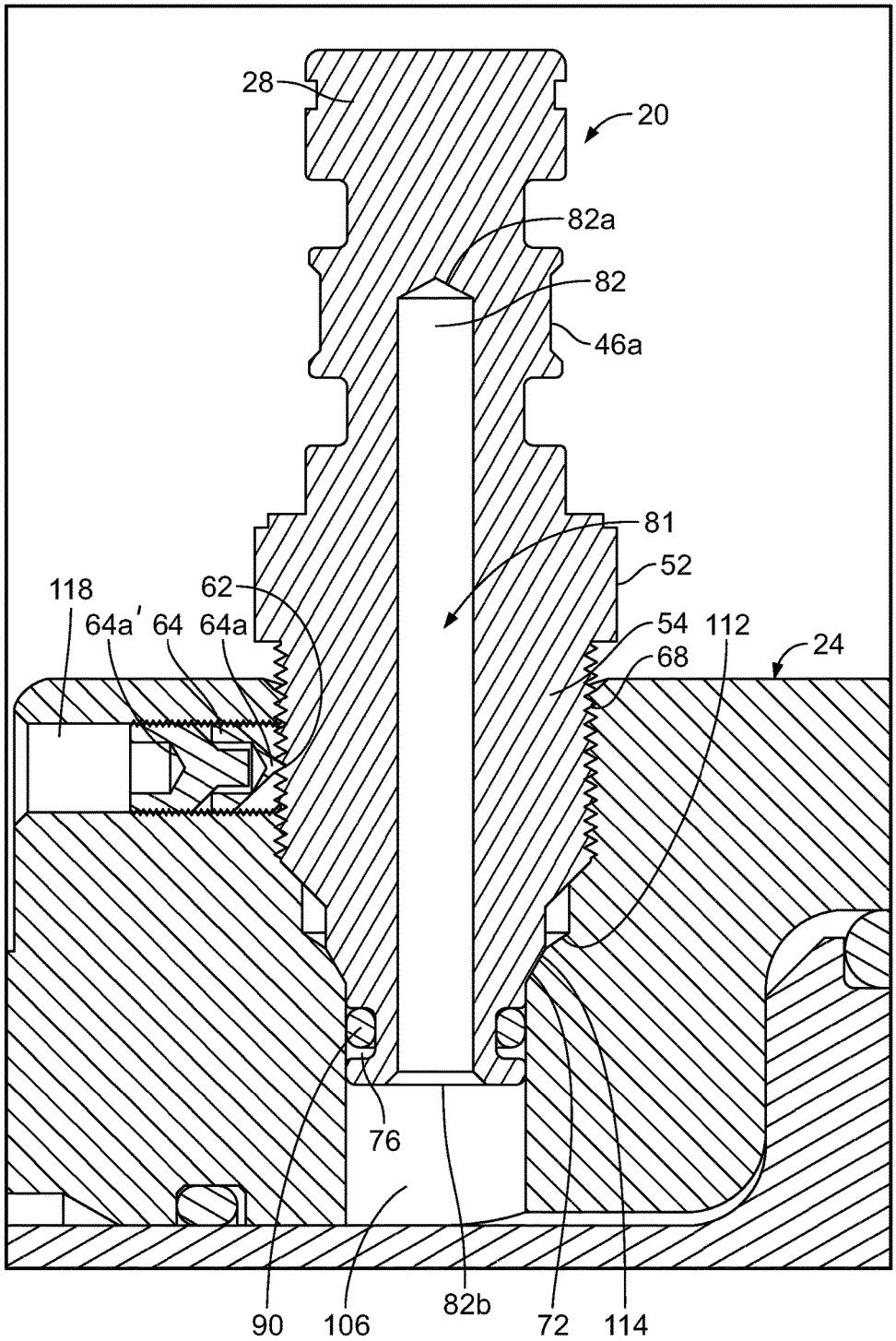
FIG. 8 is a cross-sectional view of the adapter of FIG. 7 and the inlet passageway of the cylinder.

In an embodiment as shown in FIG. 7, the first wall 54 is threaded with threads 68 which form the groove 62. As shown in FIG. 8, the fastener 64 engages within the root between adjacent threads 60 as described herein and forms a locking feature. The root of the thread 60 in which the fastener 64 engages forms the groove 62. In this embodiment, the load caused by pressure pushing the adapter 20 relative to the cylinder 24 is transferred to adapter 20, which transfers the load directly back to cylinder 24.

A compression seal 88 seats within the first recess 44; an elastomeric compression seal 90 seats within the third recess 48; and an elastomeric compression seal 92 seats within the recess 76 of the fifth wall 74. Each compression seal 88, 90 has an outer diameter that is greater than the wall portion 40 such that the compression seals 88, 90 extend outwardly from the wall portion 40 in an uncompressed condition. The compression seal 92 has an outer diameter that is greater than the fifth wall 74 such that the compression seal 92 extends outwardly from the fifth wall 74 in an uncompressed condition. Each compression seal 88, 90, 92 may be formed of an elastomeric O-ring or other suitable compressible bladder and the like.

The adapter 20 includes a passageway 81 having a first part 82 and a second part 84. The first part 82 has a first end 82*a* which is within the second reduced diameter wall section 46*a* of the fluid channel mounting portion 32 and spaced from the first end 30 of the adapter 20, and which extends through the tool engaging portion 34 and through the cylinder engaging portion 36, and terminates at a second end 82*b* which is at the second end 38 of the adapter 20. The first part 82 extends along the centerline 29 of the adapter 20. The second part 84 is provided through the second reduced diameter wall section 46*a* and is in fluid communication with the first part 82 proximate to its first end 82*a*.

The fluid channel 22 has a body 86, which may be formed of metal, having first and second ends 89, 91. The body 86 may be cylindrical. A passageway 94 extends axially through a part of the body 86. The passageway 94 has a first end 94*a* at the first end 89 of the body 86 and a second end 94*b* which is proximate to, but spaced from, the second end 91 of the body 86. A through bore 98 is provided through the body 86, is transverse to the passageway 94 and is formed by a wall. The through bore 98 is in fluid communication with the second end 94*b* of the passageway 94. The wall forming the through bore 98 is cylindrical and defines a diameter which is slightly larger than the outer diameter of the wall portion 40 of the adapter 20.

Figure 2:
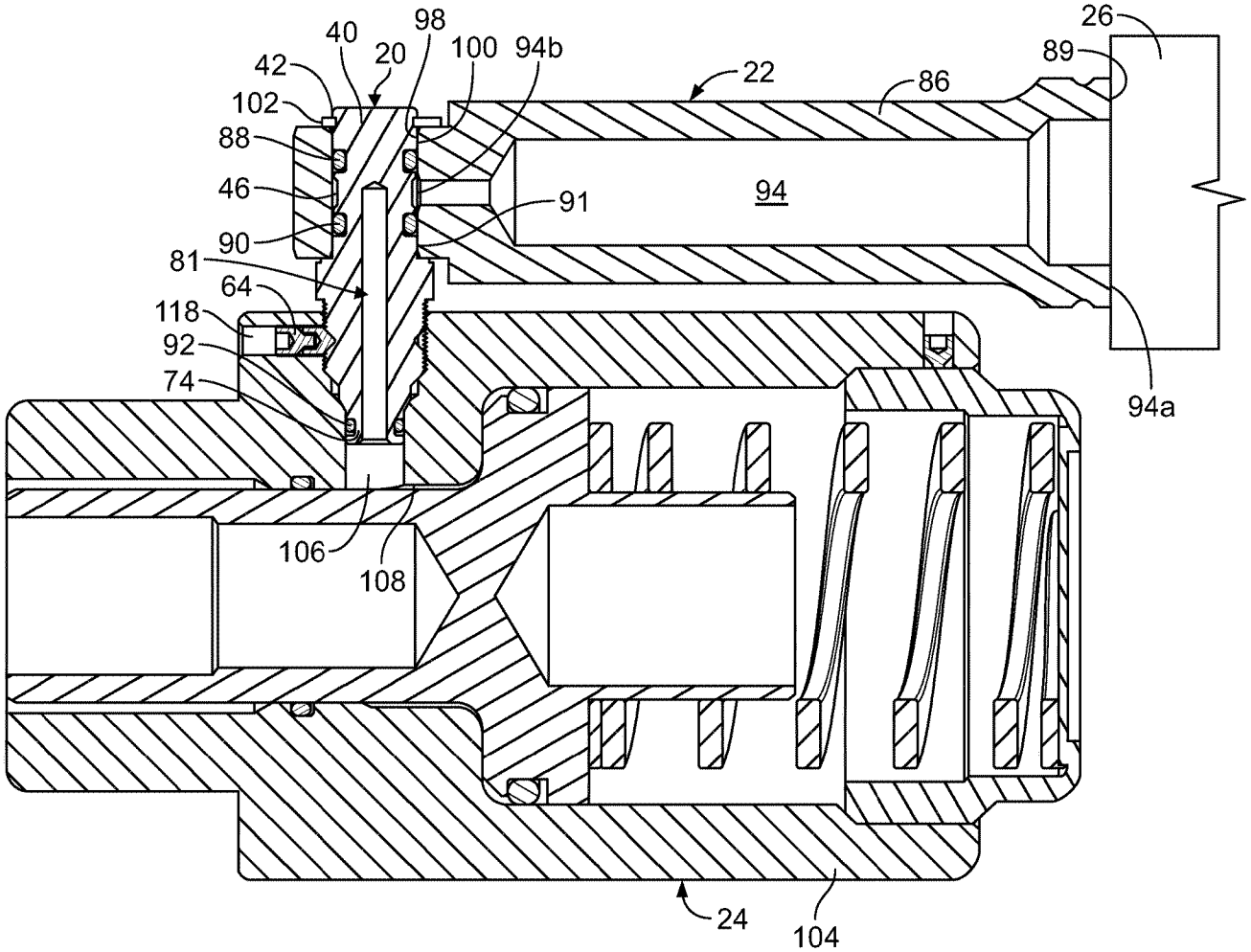
FIG. 2 is a cross-sectional view of the adapter and cylinder, and also showing a fluid channel in communication with a source of fluid medium under pressure.

The fluid channel mounting portion 32 of the adapter 20 seats through the through bore 98, with the snap-ring recess 42 extending outwardly from a first side of the body 86 and the tool engaging portion 34 and cylinder engaging portion 36 extending from an opposite second side of the body 86. A snap-ring 102, see FIG. 2, seats within the snap-ring recess 42 and engages with the side of the body 86 to prevent the removal of the adapter 20 from the fluid channel 22. The second recess 46 aligns with the second end 94*b* of the passageway 94 of the fluid channel 22. The compression seals 88, 90 engage with the wall forming the through bore 98 to form a fluid-tight seal between the adapter 20 and the fluid channel 22 and fluidically isolating the second recess 46 from the remainder of the through bore 98. The cylinder 24 and fluid channel 22 may be capable of being swiveled or rotated relative to each other around the adapter 20, with any upper maximum degree of rotation being between 0 and 360 degrees, and may be up to 360 degrees, and in some embodiments, more than 360 degrees of swiveling may be permitted, with the compression seals 88, 90 maintaining a fluid tight seal between the adapter 20 and the fluid channel 22 during the rotation. The snap-ring 102 allows for the rotation. The fluid channel 22 may be fixed in position relative to the adapter 20 by the fluid channel mounting portion 32 (for example a set screw (not shown) fixes the position) such that the fluid channel 22 is not capable of rotation. While a snap-ring 102 and associated snap-ring recess 42 are described herein, other structures for affixing the fluid channel 22 to the adapter 20 are within the scope of this disclosure. For example, but not limited to, a bolt could be provided which extends through the fluid channel 22 and engages with the adapter 20 to affix the fluid channel 22 and adapter 20 together.

The cylinder 24 includes a body 104, which may be formed of metal, having an inlet passageway 106 into which the adapter 20 is seated as described herein. The inlet passageway 106 is in fluid communication with an axial passageway 108 in which the actuating components within the cylinder 24 are mounted. The cylinder 24 may take a variety of forms. For example, the cylinder 24 may be a single acting cylinder, having the inlet passageway 106 located on a rod side of the body 104, or a pull cylinder which is often preferred for hole making applications. The cylinder 24 is used to actuate a tool (not shown), such as a crimper, a punch, etc.

Figure 5:
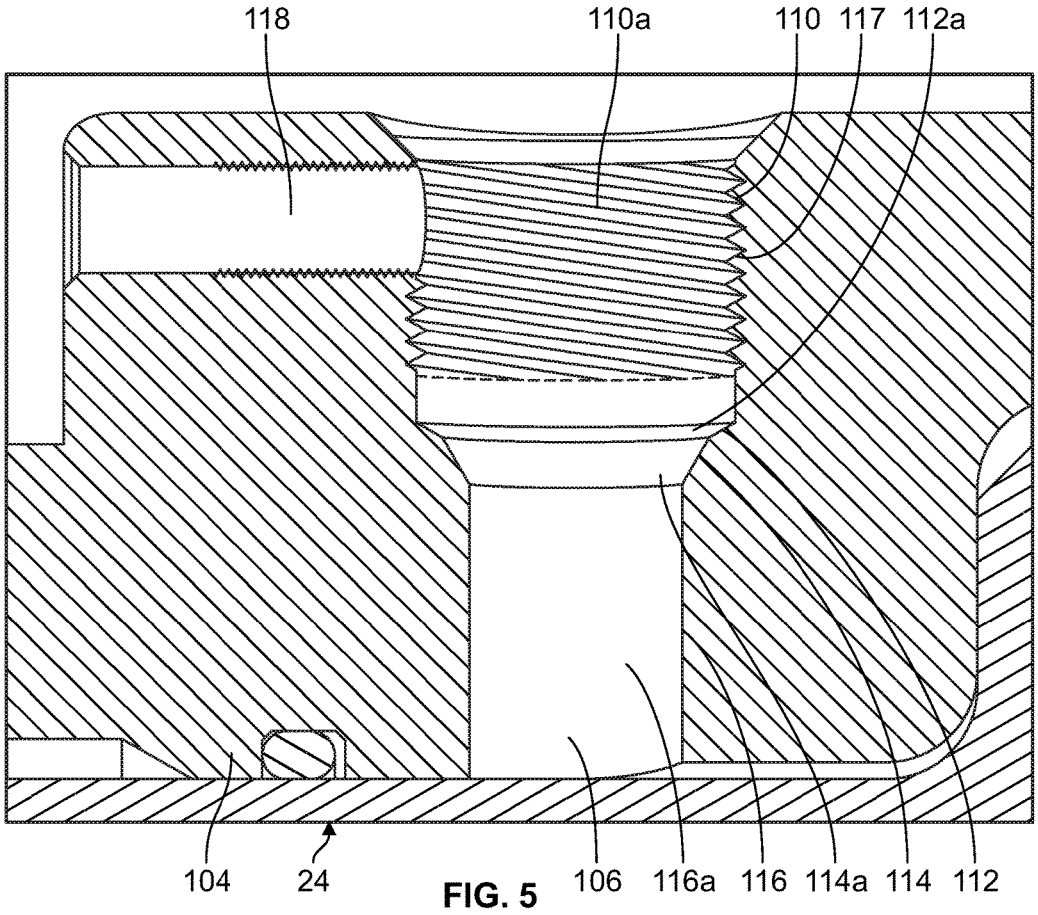
FIG. 5 is a cross-sectional view of an inlet passageway of the cylinder.

As best shown in FIG. 5, the inlet passageway 106 is formed by a first wall section 110 which forms a first part 110*a* of the inlet passageway 106, the first wall section 110 being cylindrical, a second wall section 112 which forms a second part 112*a* of the inlet passageway 106, which extends from the first wall section 110 and is conical, a third wall section 114 which forms a third part 114*a* of the inlet passageway 106, which extends from the second wall section 112 and is conical, and a fourth wall section 116 which forms a fourth part 116*a* of the inlet passageway 106, which extends from the third wall section 114 and is cylindrical. The first wall section 110 is threaded with threads 117 and defines a diameter which is greater than the diameter defined by the fourth wall section 116. The conical third wall section 114 is angled relative to the first and fourth wall sections 110, 116 at a 60-degree angle. The angle at which the conical third wall section 114 is angled relative to the first and fourth wall sections 110, 116 is greater than the angle at which the conical second wall section 112 is angled relative to the first and fourth wall sections 110, 116.

The body 104 includes a fastener receiving passageway 118 which is angled relative to the inlet passageway 106 and is in communication with the inlet passageway 106. The fastener receiving passageway 118 may be transverse to or parallel to the axial passageway 108 of the cylinder 24. The fastener receiving passageway 118 may be tangential or off-center relative to the cylinder 24.

The adapter 20 is mounted into the inlet passageway 106 by threading the first wall 54 of the adapter 20 into the first wall section 110 of the cylinder 24 by using a tool, such as a wrench, to engage the flat wall portions 52 of the tool engaging portion 34, until the fourth wall 72 of the adapter 20 engages with the third wall section 114. This engagement of the fourth wall 72 and the third wall section 114 forms a seat to prevent the further insertion of the adapter 20 into the cylinder 24. The threaded engagement of the first wall 54 and first wall section 110 and the abutting engagement of the fourth wall 72 and the third wall section 114 form a joint between the adapter 20 and the cylinder 24. The fourth wall section 116 of the cylinder 24 is sized to be slightly larger than the fifth wall 74 of the adapter 20. When the adapter 20 is seated in the inlet passageway 106 of the cylinder 24, the fifth wall 74 is proximate to the fourth wall section 116 and the compression seal 92 forms a fluid tight seal between the adapter 20 and the cylinder 24. The sealing compression seal 92 is distal to the joint and the seat formed between the adapter 20 and the cylinder 24.

Torque is applied to the adapter 20 by rotation of the adapter 20 using the tool on the flat wall portions 52. This torque translates to the seat formed by the engagement of the fourth wall 72 and the third wall section 114 through the threads 60, 117. Since the compression seal 92 is distal and separate from the torqued portion of the joint between the adapter 20 and the cylinder 24, this allows for high torquing and a greater shear area because the larger diameter first wall 54 of the adapter 20 which has the threads 60 is not grooved for a compression seal for sealing the adapter 20 to the cylinder 24. In addition, the design allows the compression seal 92 to be made very small, therefore minimizing force on the adapter 20 due to the internal pressure of the fluid medium within the cylinder 24.

After the adapter 20 is seated within the cylinder 24, the fastener 64, such as a set screw, is seated within the fastener receiving passageway 118 and the end 64*a* of the fastener 64 engages within the groove 62, FIG. 6, or between crests and within a root of the thread 68, FIG. 6, to form a positive lock between the fastener 64, the cylinder 24 and the adapter 20. While a set screw is shown, it is to be understood that other structures for creating a positive lock can be provided, for example, a pin. The positive lock created by the fastener 64 prevents the adapter 20 from loosening from the body 104 of the cylinder 24. It is not possible for the adapter 20 to loosen when the fastener 64 is mated with the adapter 20, however, if desired, a second fastener 64*a*' may be used to lock the first fastener 64 in place as another contingency. As an alternative, the fastener 64 may be press-fit into the fastener receiving passageway 118, may be adhesively secured within the fastener receiving passageway 118, and the like such that the easy removal of the fastener 64 is prevented. The threaded engagement of the first wall 54 of the adapter 20 and the first wall section 110 of the cylinder 24 provide an additional lock feature.

In use, the cylinder 24 receives a fluid medium, such as hydraulic oil, from the source 26, through the fluid channel 22 and the adapter 20. The fluid medium flows through the fluid channel passageway 94, through the fluid channel through bore 98, into the second recess 46 of the adapter 20, through the second part 84 of the passageway 81, through the first part 82 of the passageway 81, into the inlet passageway 106 of the cylinder 24, and then into the axial passageway 108 of the cylinder 24 to actuate the mechanisms within the cylinder 24. The fluid medium is pumped from the source under high pressure either by a motor or by hand.

Because of the design of the adapter 20, the high stress which is concentrated on cylinder 24 at the inlet passageway 106 does not affect the adapter 20. The adapter 20 includes multiple contingent locking mechanisms, combined with a seal configuration that maintains robustness and strength in the joint between the adapter 20 and the cylinder 24. The diameters of the adapter 20 accommodate expected shear strengths due to external and internal loads and installation torque, while maintaining a large enough fluid path through the center to supply fluid medium to the cylinder 24.

Figure 12:
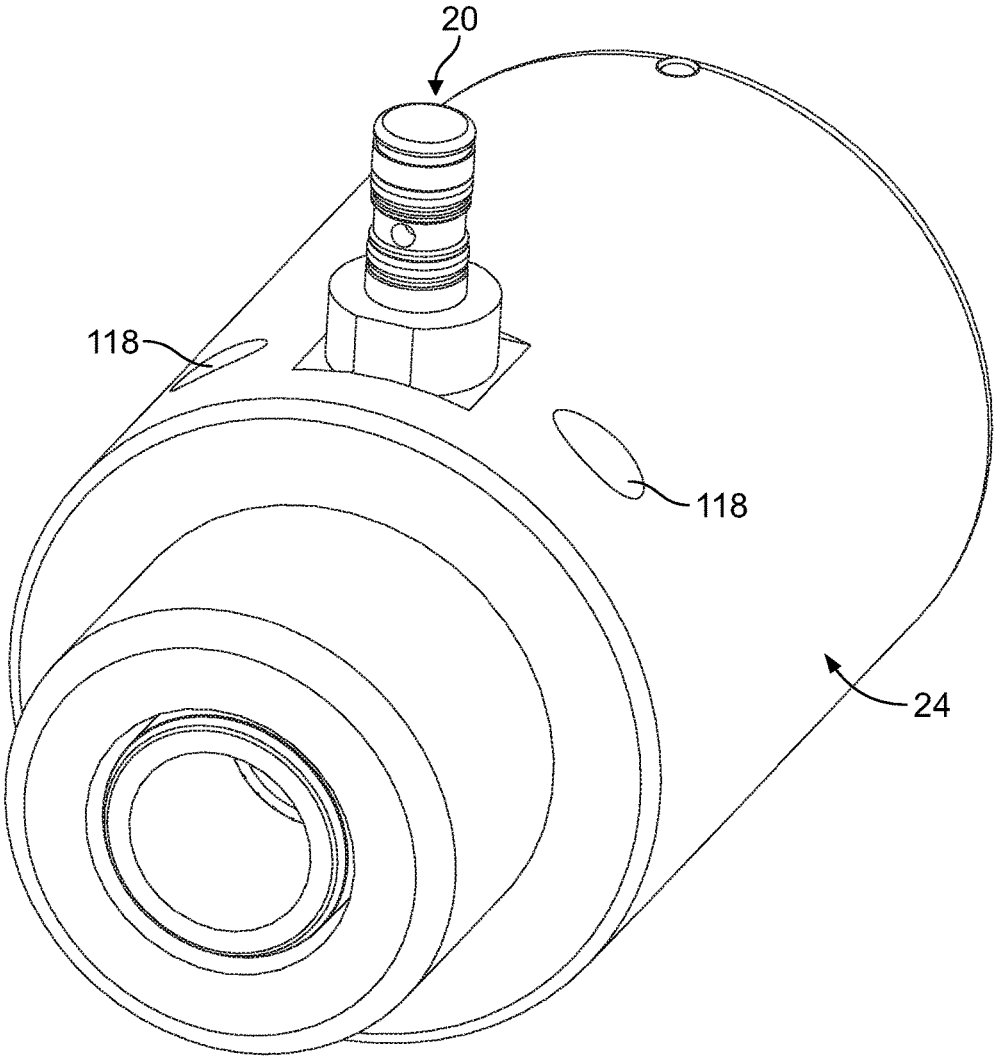
FIG. 12 is a perspective view of a modified cylinder.
Figure 13:
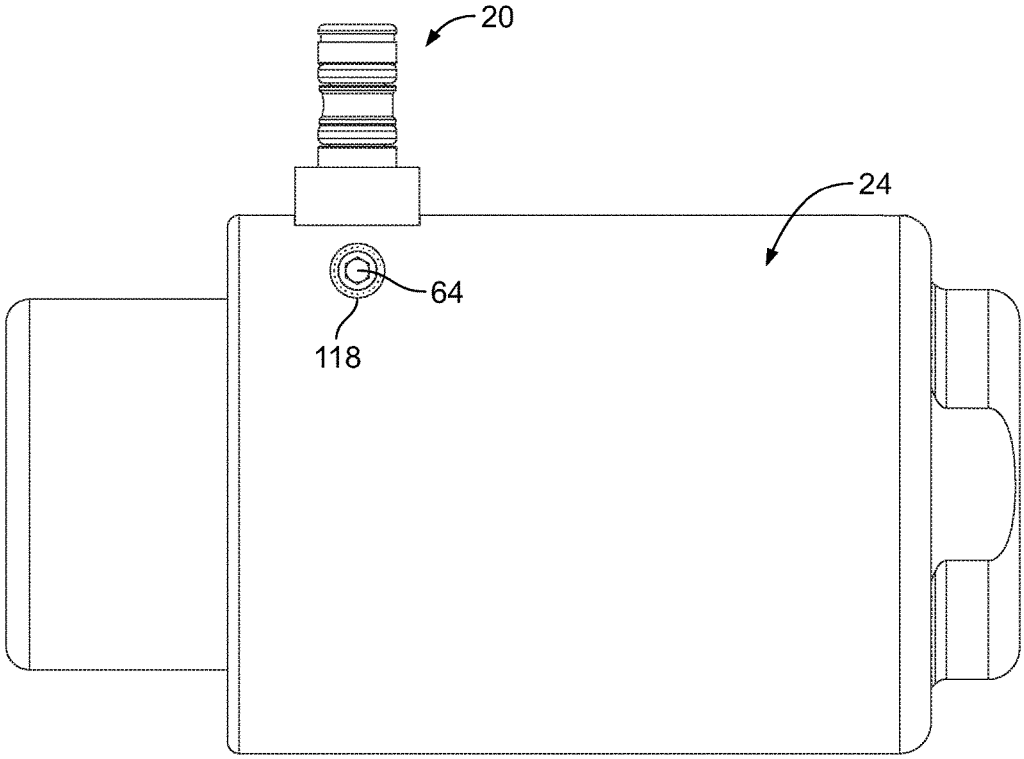
FIG. 13 is a side elevation view of the modified cylinder of FIG. 12.

As shown in FIGS. 12 and 13, two fastener receiving passageways 118 are provided and are fastener receiving passageways are diametrically opposed from each other. The fastener receiving passageways 118 can be positioned in other positions than being diametrically opposed. The fastener receiving passageways 118 are angled relative to the axial passageway 108 of the cylinder 24. The fastener receiving passageways 118 may be perpendicular to the axial passageway 108, or tangential or off-center relative to the adapter 20. A fastener 64, such as a set screw, is engaged within each passageway 118. With the embodiment shown in FIG. 3, an end 64*a* of each fastener 64 engages within the respective groove 62. With the embodiment shown in FIG. 7, an end 64*a* of each fastener 64 engages between crests of the thread 68, e.g., the ends 64*a* of the fasteners 64 engage within the root of the thread 68. The fastener 64 may be threadedly engaged with the fastener receiving passageway 118 as shown in the drawings, may be press-fit into the fastener receiving passageway 118, may be adhesively secured within the fastener receiving passageway 118, and the like such that the easy removal of the fastener 64 is prevented. While a set screw is shown, it is to be understood that other structures for creating a positive lock can be provided, for example, a pin. The positive lock created by the fastener 64 prevents the adapter 20 loosening from the body 104 of the cylinder 24. While two fastener receiving passageways 118 and fasteners 64 are shown in FIGS. 12 and 13, it is to be understood that more than two fastener receiving passageways 118 and fasteners 64 can be provided.

Figure 9:
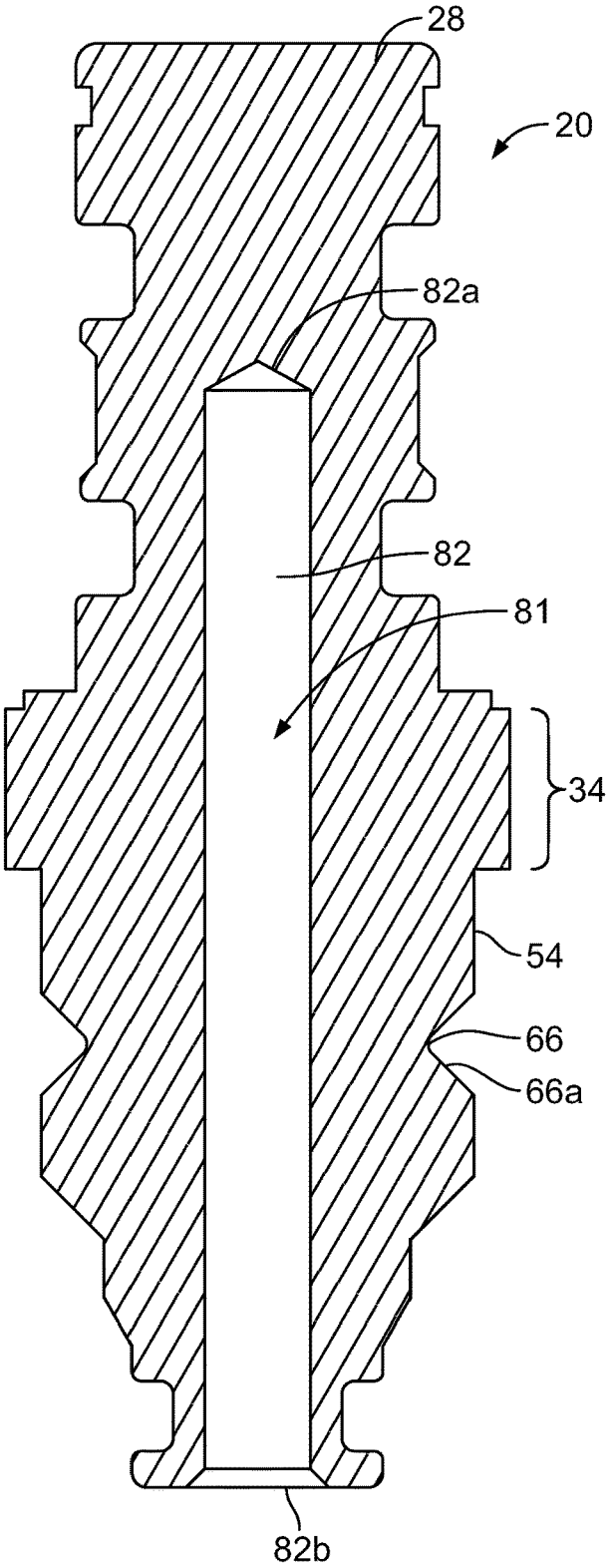
FIG. 9 is a cross-sectional view of another alternate adapter.
Figure 10:
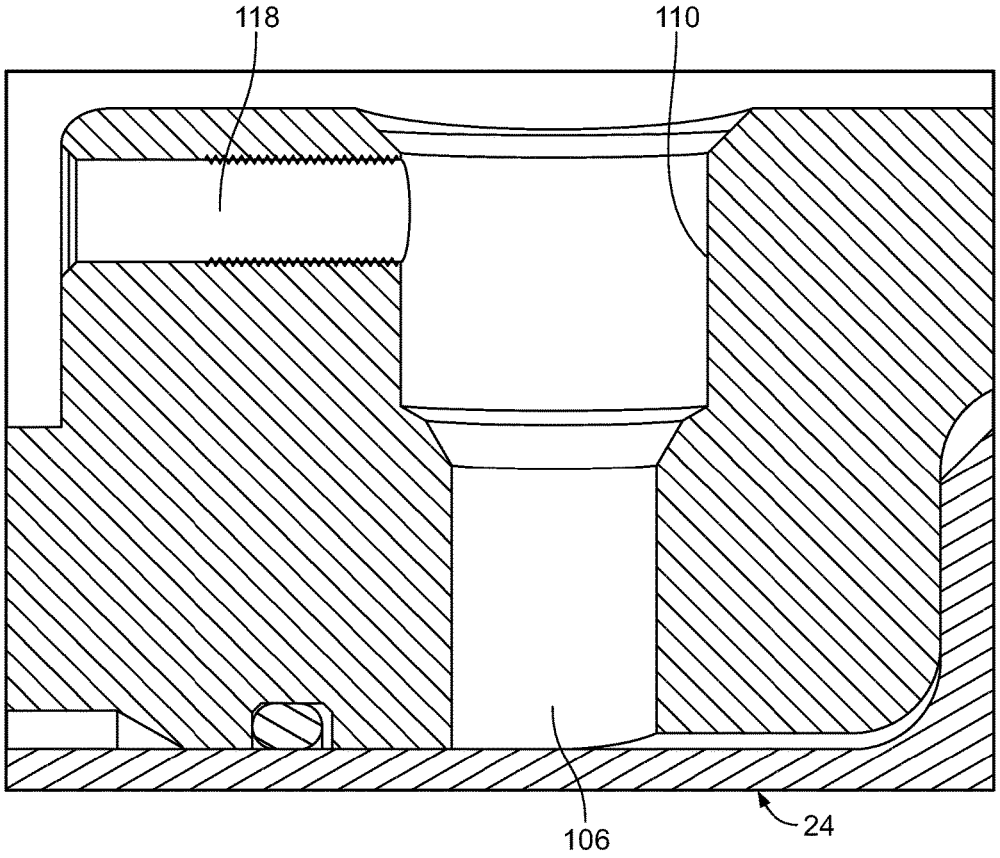
FIG. 10 is a cross-sectional view of an alternate inlet passageway of the cylinder to be used with the adapter of FIG. 9.
Figure 11:
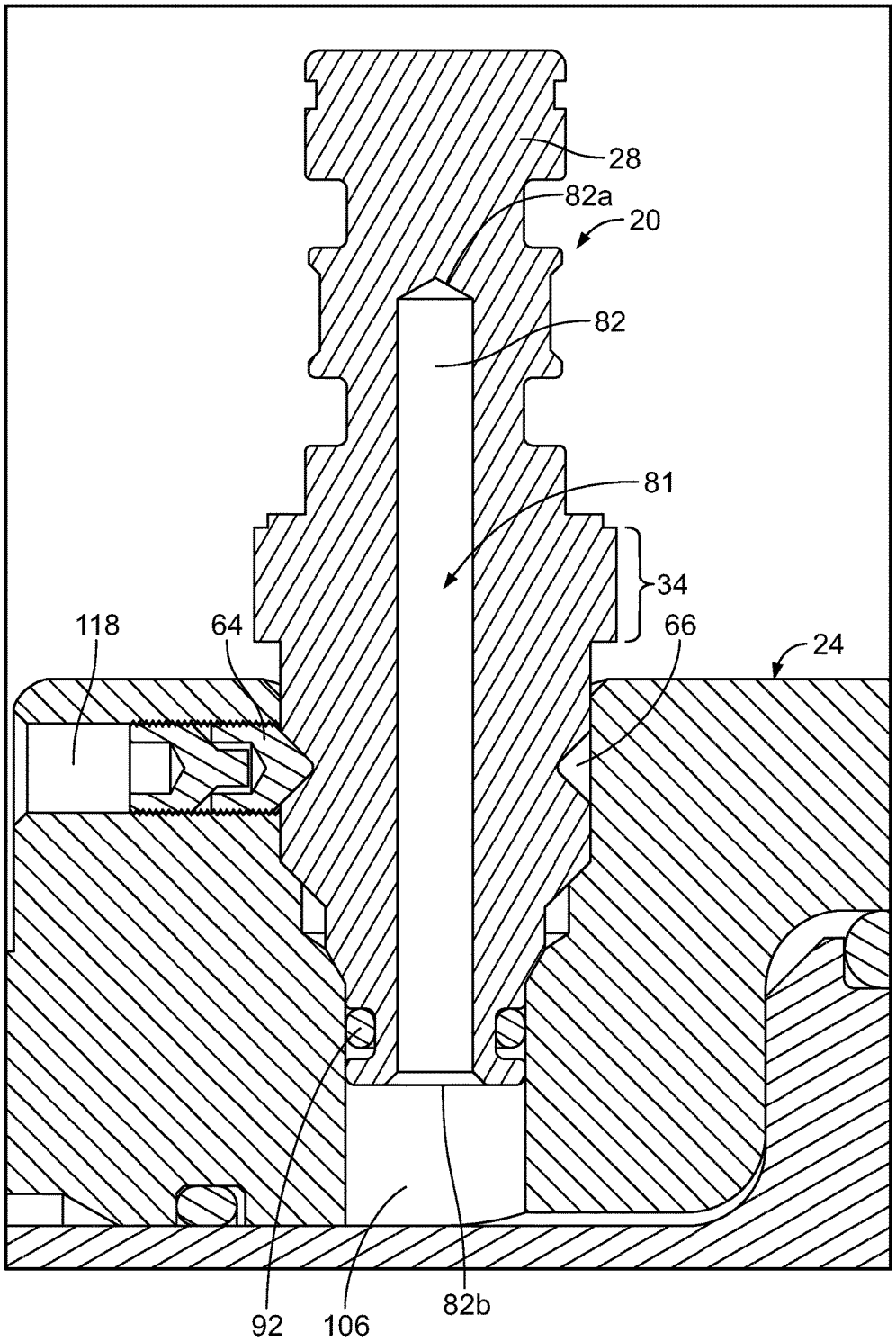
FIG. 11 is a cross-sectional view of the adapter of FIG. 9 and the inlet passageway of FIG. 10.

An alternate embodiment of the adapter 20 and cylinder 24 are shown in FIGS. 9-11. The adapter 20 and cylinder 24 are identical to that described hereinabove, except that the first wall 54 of the adapter 20 is unthreaded and has a groove 66 provided therein which is spaced from the tool engaging portion 34 and which forms a reduced diameter wall section 66*a* of the wall portion 40, and the first wall section 110 of the inlet passageway 106 of the cylinder 24 is unthreaded. The groove 66 may extend around the entire perimeter of the wall 54 or may extend around a portion of the perimeter of the wall 54. The reduced diameter wall section 66*a* defines a diameter which is less than the diameter of the wall 54. The fastener 64 seats within the groove 66 to form the lock between the adapter 20 and the cylinder 24. The groove 66 may be formed by machining. In this embodiment, the load caused by pressure pushing the adapter 20 relative to the cylinder 24 the load is transferred to the adapter 20, which then transfers the load to the fastener 64, which transfers the load back to the cylinder 24.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. An assembly comprising:

a cylinder having a wall forming a fluid inlet passageway and a wall forming a plurality of fastener receiving passageways, each fastener receiving passageway being in communication with the fluid inlet passageway;

an adapter comprising a wall having a proximal end and a distal end, the wall including a first portion adapted to mount to an associated source of a fluid medium and extending from the proximal end, a second portion adapted to be engaged with an associated tool which can apply a torque to the adapter, the second portion extending from the first portion, a third portion extending from the second portion, the third portion seated within the fluid inlet passageway of the cylinder, and a fluid passageway extending through the adapter and in communication with the fluid inlet passageway of the cylinder, the fluid passageway having a first part and a second part, the first part having a first end and a second end, the first part extending along a centerline of the adapter, the first end being within a reduced diameter wall section of the first portion, the first end being spaced from the proximal end of the adapter, the first part extending through the second portion and through the third portion, the second end being at the distal end of the adapter, and the second part extending through the reduced diameter wall section;

a seal sealing the third portion of the adapter to the wall forming the fluid inlet passageway; and a fastener mounted in each fastener receiving passageway and in engagement with the third portion of the adapter, the seal being distal to the fastener, wherein two abutting fasteners are mounted in at least one of the fastener receiving passageways.

2. The assembly of claim 1, wherein two of the fastener receiving passageways are diametrically opposed from each other.

3. The assembly of claim 1, wherein two abutting fasteners are mounted in each fastener receiving passageway.

4. The assembly of claim 1, wherein each fastener is threadedly engaged with the respective fastener receiving passageway.

5. The assembly of claim 1, wherein the third portion comprises a wall having a groove formed therein into which each fastener is engaged and a recess formed therein which is spaced from the groove; and a compression seal seated within the recess which forms the seal between the third portion of the adapter and the wall forming the fluid inlet passageway of the cylinder.

6. The assembly of claim 5, wherein the third portion further comprises a first cylindrical wall having a first diameter and extending from the second portion, the first cylindrical wall having the groove formed therein, a second cylindrical wall extending from the first cylindrical wall and having a second diameter which is less than the first diameter, the second cylindrical wall having the recess formed therein.

7. The assembly of claim 6, further comprising at least one conical wall provided between the first and second cylindrical walls.

8. The assembly of claim 5, further comprising threads on a portion of the wall of the third portion, and the groove has a depth which is greater than a root depth of the threads.

9. The assembly of claim 5, wherein a portion of the wall of the third portion is threaded with threads and the groove is formed by a root of adjacent threads.

10. The assembly of claim 5, wherein the wall of the third portion is unthreaded.

11. The assembly of claim 1, wherein the walls of the adapter and the cylinder are formed of metal.

12. The assembly of claim 1, wherein the wall forming the fluid inlet passageway in the cylinder is threaded and the third portion of the adapter has a threaded wall, the threaded wall of fluid inlet passageway and the threaded wall of the third portion of the adapter being interengaged.

13. The assembly of claim 1, wherein the wall forming the fluid inlet passageway in the cylinder is unthreaded and the third portion of the adapter is unthreaded.

14. The assembly of claim 1, further comprising a fluid channel engaged with the first portion of the adapter, the fluid channel capable of swiveling relative to the adapter.

15. The assembly of claim 14, further comprising a source of fluid medium attached to the fluid channel.

16. The assembly of claim 1, further comprising a source of fluid medium attached to the adapter.

* * * * *